US009126067B2

(12) United States Patent
Miscioscia et al.

(10) Patent No.: US 9,126,067 B2
(45) Date of Patent: Sep. 8, 2015

(54) SAFETY ASSEMBLY FOR CONTAINERS AND CONDUITS FOR COMBUSTIBLE FLUIDS

(71) Applicant: Giovanni Miscioscia, Genoa (IT)

(72) Inventors: Giovanni Miscioscia, Genoa (IT); Giorgio Mandruzzato, Genoa (IT)

(73) Assignee: Giovanni Miscioscia, Genoa (IT)

( * ) Notice: Subject to any disclaimer, the term of this patent is extended or adjusted under 35 U.S.C. 154(b) by 0 days.

(21) Appl. No.: 14/368,409

(22) PCT Filed: Dec. 19, 2012

(86) PCT No.: PCT/EP2012/005256

§ 371 (c)(1),
(2) Date: Jun. 24, 2014

(87) PCT Pub. No.: WO2013/102478

PCT Pub. Date: Jul. 11, 2013

(65) Prior Publication Data

US 2014/0332531 A1 Nov. 13, 2014

(30) Foreign Application Priority Data

Jan. 5, 2012 (IT) ..... GE2012A0001

(51) Int. Cl.

| | |
|---|---|
| ***A62C 3/06*** | (2006.01) |
| ***G08B 13/186*** | (2006.01) |
| *A62C 4/00* | (2006.01) |

(52) U.S. Cl.

CPC ..... *A62C 3/065* (2013.01); *G08B 13/186* (2013.01); *A62C 4/00* (2013.01)

(58) Field of Classification Search

CPC ..... A62C 3/065; A62C 3/06; A62C 3/00; A62C 13/003; A62C 13/76; B65D 90/22; B65D 51/1611; B65D 51/1605; B65D 51/16; B65D 51/1622

USPC ..... 220/88.1, 367.1, 374, 373, 560.01; 215/307; 222/188, 481; 169/35, 30, 89, 169/56, 57, 58, 70, 26

See application file for complete search history.

(56) References Cited

U.S. PATENT DOCUMENTS 1,363,271 A * 12/1920 Reschke ..... 169/60
1,965,089 A * 7/1934 Weingessel ..... 222/188

FOREIGN PATENT DOCUMENTS

FR 371 699 A 3/1907
FR 446 907 A 12/1912

* cited by examiner

*Primary Examiner* — Robert J Hicks
(74) *Attorney, Agent, or Firm* — R. Neil Sudol; Henry D. Coleman

(57) ABSTRACT

A safety assembly for containers and conduits for combustible fluids comprises a casing that contains an extinguishing substance and is crossed by a thermolabile conduit. The conduit is open to the outside through an outlet hole and is open to the inside of a container or a conduit, through an inlet hole.

4 Claims, 4 Drawing Sheets

SAFETY ASSEMBLY FOR CONTAINERS AND CONDUITS FOR COMBUSTIBLE FLUIDS

BACKGROUND OF THE INVENTION

The present invention relates to a safety assembly for containers and conduits for combustible fluids.

The present invention relates in particular to a cap, usable for containers of alcohol and other combustible fluids, and adapted to protect the user from back fires.

As is known, pouring or spraying combustible liquid onto an open flame is very dangerous because of the possible back fire, which causes the ignition of the fuel contained in the container or conduit.

A typical case is the dangerous habit of pouring alcohol from the bottle directly onto a barbecue, an operation that has caused many severe accidents.

FR371699 discloses a safety device applicable to a gas tank for preventing the onset of fire or explosions.

FR446907 discloses a stopper for bottles and other vessels and adapted to prevent fire from entering the vessel.

OBJECTS OF THE INVENTION

The aim of the present invention is to provide a safety assembly, particularly for containers and conduits for combustible liquids, that allows to dispense the combustible liquid while at the same time providing protection against back fires.

Within the scope of this aim, an object of the invention is to provide an assembly that is capable of extinguishing the flame immediately, preventing its propagation upstream of said assembly.

Another object of the invention is to provide an assembly that can have various and multiple applications for vessels and ducts for flammable liquids.

Another object is to provide an assembly that can be provided easily, using commonly commercially available elements and materials, and is also competitive from an economic standpoint.

A particular object of the present invention is to provide an assembly that can be used for widely consumed products.

SUMMARY OF THE INVENTION

This aim and these and other objects that will become better apparent hereinafter are achieved by a safety assembly for containers and conduits for combustible fluids, characterized in that it comprises a casing that contains an extinguishing substance and is crossed by a thermolabile conduit that is open to the outside through an outlet hole, and that is open to the inside of a container or a conduit, through an inlet hole.

BRIEF DESCRIPTION OF THE DRAWINGS

Further characteristics and advantages will become better apparent from the description of preferred but not exclusive embodiments of the invention, illustrated by way of non-limiting example in the accompanying drawings, wherein.

DETAILED DESCRIPTION

Figure 1:
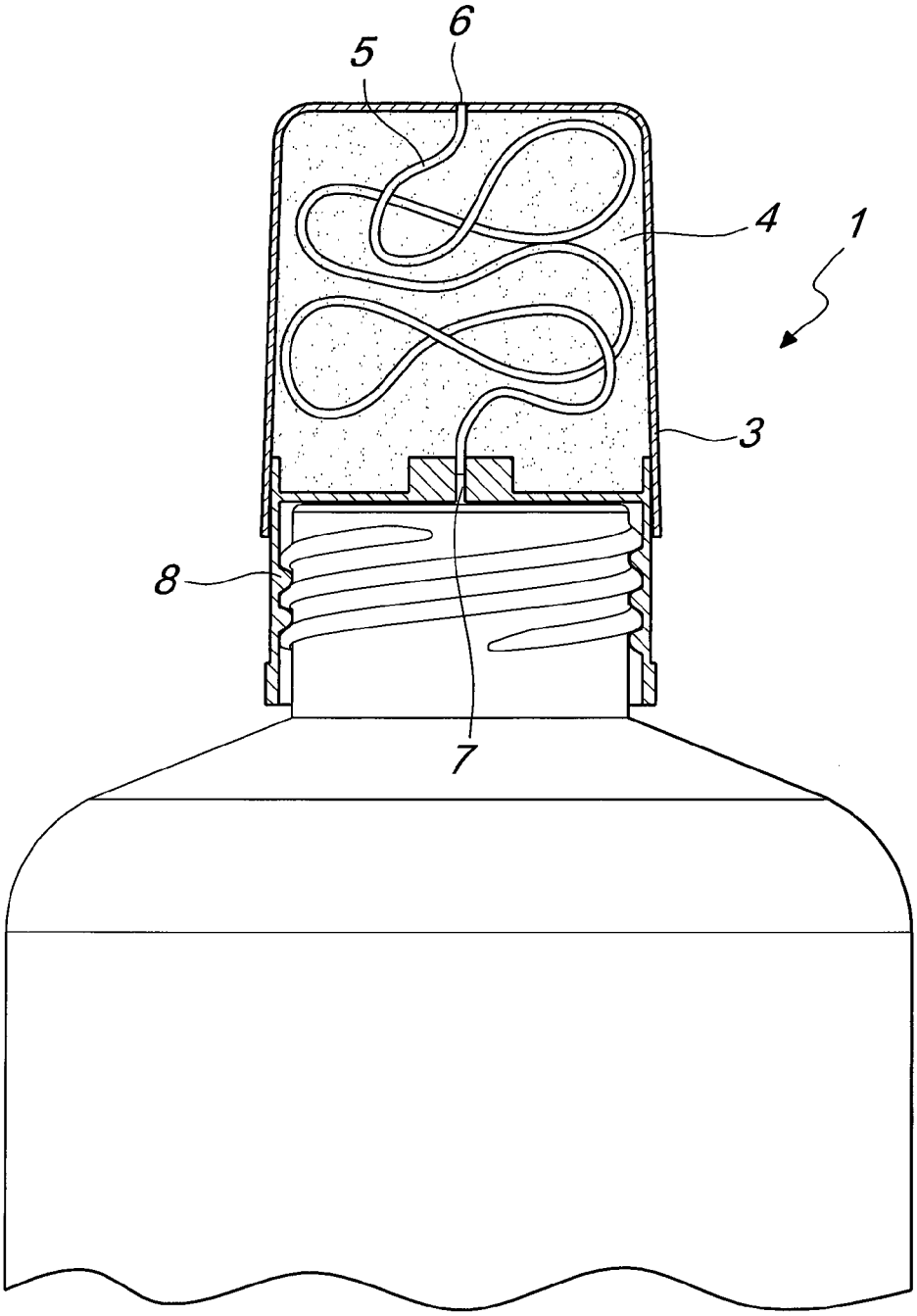
FIG. 1 is a partial sectional view of a safety assembly provided as a cap for a vessel.
Figure 2:
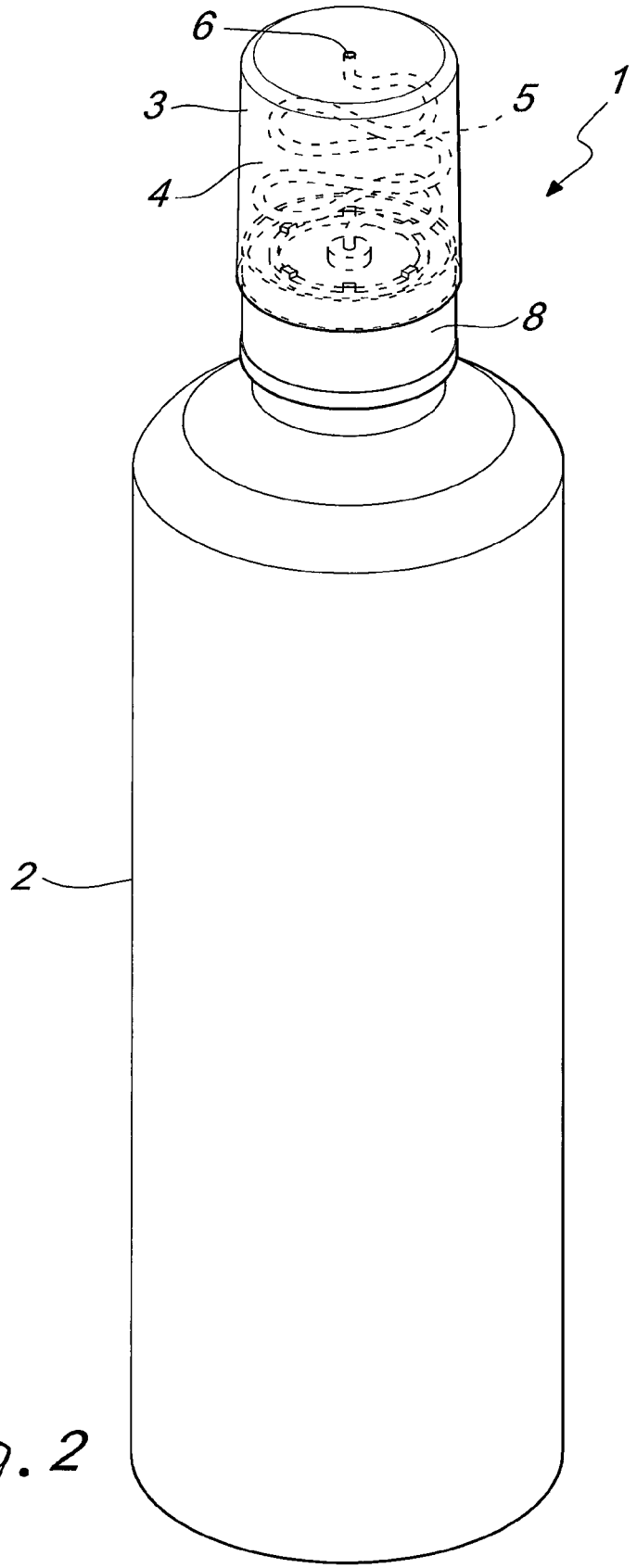
FIG. 2 is a perspective view of a vessel of combustible liquid provided with a dispensing cap constituted by the safety assembly according to the present invention.
Figure 3:
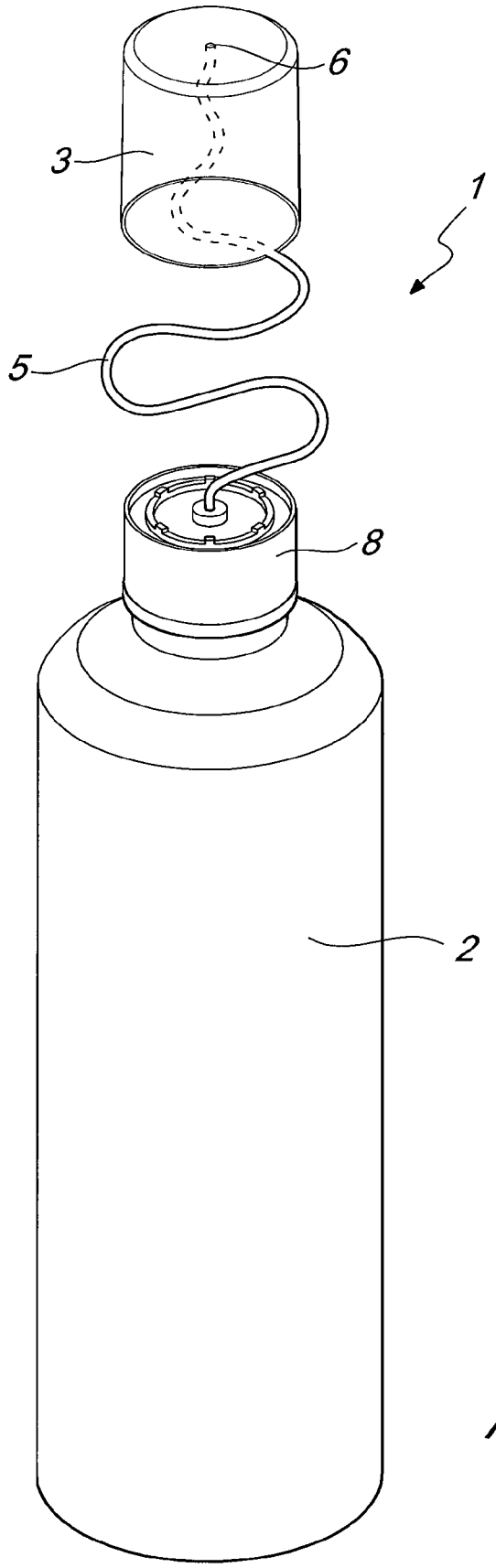
FIG. 3 is a partially exploded perspective view, similar to the preceding one, of the cap.

With reference to the cited figures, the safety assembly, particularly for containers and conduits of combustible liquids, according to the invention, generally designated by the reference numeral 1, is shown in the form of a dispensing cap that can be applied to a vessel 2 of combustible liquid, for example a bottle of denatured alcohol.

The safety assembly 1 comprises a casing that contains an extinguishing substance 4 and is crossed by a thermolabile conduit 5 that is open to the outside, by means of a dispensing hole 6, and is open to the inside of the vessel 2, through an inlet hole 7.

In the illustrated example, the assembly 1 is applied to a vessel 2; however, the same assembly can also be applied to other objects containing combustible liquids, such as for example a pipe or a union, etc.

The assembly 1 can also be used at an intermediate position in a pipe.

In this embodiment, the casing 3 is constituted by a cup that is applied to a base 8 that can be applied to the neck of the vessel 2, for example by means of a screw connection of the type normally used to apply dispensing caps to bottles of denatured alcohol.

The assembly 1, shaped like a cap, can be provided with a cover for protecting the dispensing hole 6, not visible in the figures, of a per se known type.

The operation of the safety assembly according to the present invention is as follows.

The thermolabile conduit 5 allows the passage of combustible liquid from the vessel 2, or from another structure such as a pipe, to the delivery hole, which can be open onto the outside environment or connected to a conduit or other similar structure.

If a flame travels back along the thermolabile tube 5, said tube melts and the flame is extinguished immediately by the extinguishing substance 4, contained within the casing 3, and by the lack of oxygen.

Figure 4:
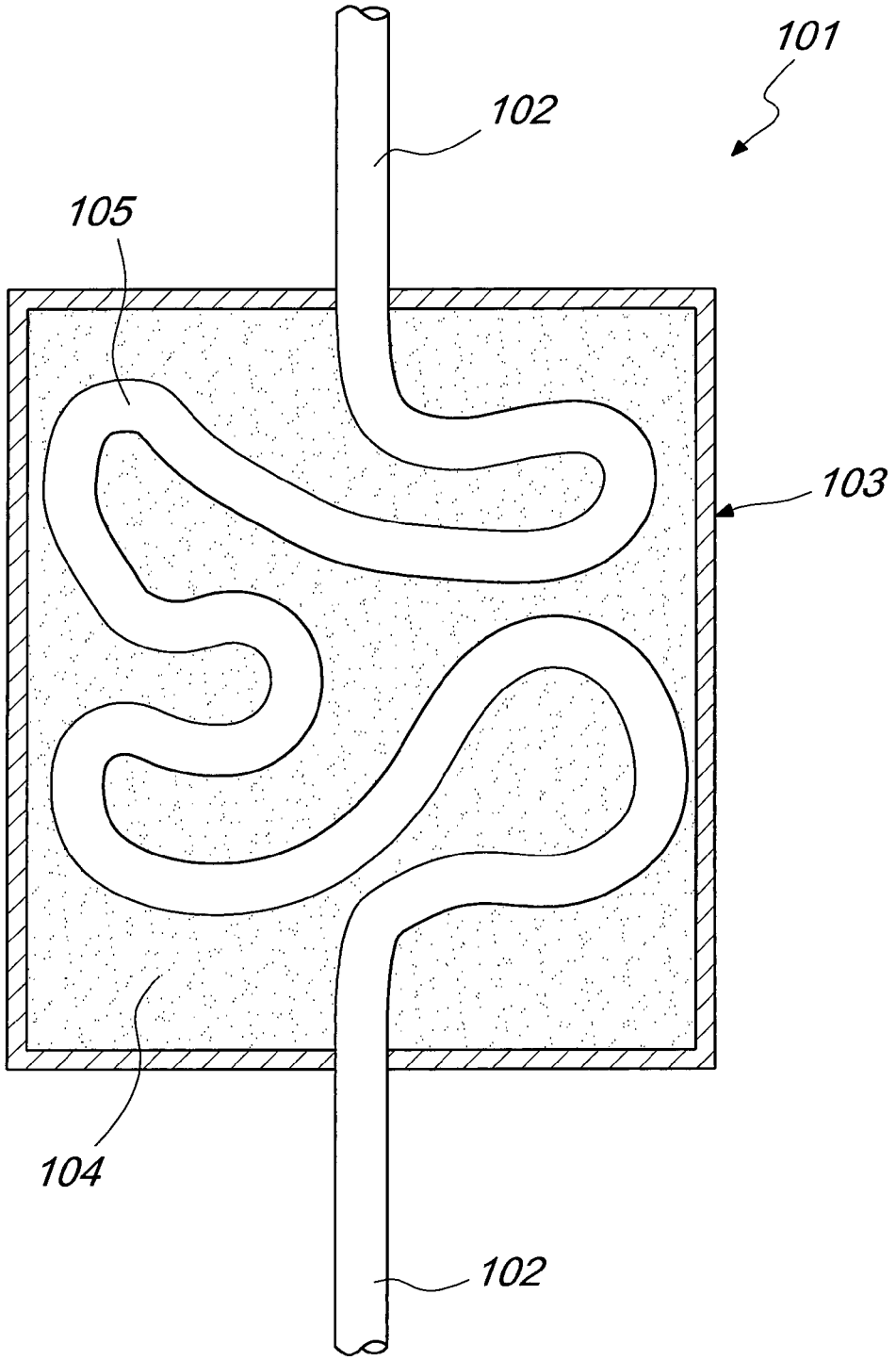
FIG. 4 is a sectional view of a safety assembly applied to a conduit.

FIG. 4 is a schematic view of the application of the safety assembly, generally designated by the reference numeral 101, to a conduit 102, for example a pipeline.

The safety assembly 101 comprises a casing 103 that contains an extinguishing substance 104 and is crossed by a thermolabile conduit 105.

The thermolabile conduit 105 has its inlet and outlet ends connected to the conduit 102, at the perimeter of the casing 103.

The thermolabile conduit 105 can also be an integral part of the conduit 102, which, at least in the portion inside the casing 103, must have thermolability characteristics.

The operation of the assembly 101 applied to a conduit 102 is fully similar to the operation of the assembly 1 described above.

The thermolabile conduit 105 allows the passage of combustible liquid that flows in the conduit 102.

If a flame travels back along the thermolabile tube 105, said tube melts and the flame is extinguished immediately by the extinguishing substance 104 that is contained within the casing 103 and by the lack of oxygen.

The safety assembly according to the present invention can be used in several different situations.

The assembly can be used as a cap for a bottle, as in the illustrated example, as an intermediate element along a pipe, or as a station in complex systems with Y-shaped or X-shaped joints.

In practice it has been found that the invention achieves the intended aim and objects, providing a safety assembly that can be applied to systems for delivering or conveying flammable liquids and capable of blocking any back fire, preventing the ignition of the fuel upstream of said assembly.

By virtue of its low cost and constructive simplicity, the present assembly can be advantageously used in widely consumed products, for example as a safety cap for vessels of denatured alcohol.

This application claims the priority of Italian Patent Application No. GE2012A000001, filed on Jan. 5, 2012, the subject matter of which is incorporated herein by reference.

The invention claimed is:

1. A safety assembly for vessels and conduits for combustible fluids, comprising a casing that contains an extinguishing substance and is crossed by a thermolabile tube that is adapted to convey a combustible fluid from a vessel or conduit containing the combustible fluid, said tube being open to the outside through an outlet hole, said tube being open to the inside of the vessel or a conduit containing the combustible fluid, through an inlet hole, said tube being further adapted to break up or melt by flame traveling through the thermolabile tube.

2. The safety assembly according to claim 1, wherein said casing is arranged at said conduit.

3. The safety assembly according to claim 1, wherein said casing is constituted by a cup applied to a base associated with said vessel.

4. The safety assembly according to claim 2, wherein said thermolabile tube is an integral part of said conduit.

* * * * *